US005915856A

United States Patent [19]

Yeranossian

[11] Patent Number: 5,915,856

[45] Date of Patent: Jun. 29, 1999

[54] TUBULAR SWING AWAY SIGN

[75] Inventor: Karl Yeranossian, Pearl River, N.Y.

[73] Assignee: P.O.P. Displays, Inc., Woodside, N.Y.

[21] Appl. No.: 09/087,196

[22] Filed: May 29, 1998

Related U.S. Application Data

[60] Provisional application No. 60/048,315, May 30, 1997.

[51] Int. Cl.[6] ..... G09F 3/18

[52] U.S. Cl. ..... 40/606; 40/661.03; 248/534; 248/535; 211/107

[58] Field of Search ..... 40/606, 607, 661.03, 40/658, 660, 661, 666; 248/534, 535, 223.41, 225.11; 211/107, 88.03

[56] References Cited

U.S. PATENT DOCUMENTS 3,540,687 11/1970 Cuva ..... 248/223.41
4,373,693 2/1983 Greenberger ..... 248/223.41
5,617,661 4/1997 Mason ..... 40/606

OTHER PUBLICATIONS

William Merit & Associates, Instructions for Assembly of Aisle Invader, Date: unknown, pp. 1 & 2.

*Primary Examiner*—Cassandra H. Davis
*Attorney, Agent, or Firm*—Nolte, Nolte & Hunter

[57] ABSTRACT

A tubular swing away sign attached to a display counter via a flexible chip. The swing away sign provides an inexpensive device for displaying advertisements or notices which can withstand mild lateral forces associated with passing consumers. In addition, the swing away sign provide a clear tubular display sign which maximizes display area and minimizes the protrusion of the sign into the customers walkway.

1 Claim, 2 Drawing Sheets

TUBULAR SWING AWAY SIGN

This application claims benefit of provisional application Ser. No. 60/048,315, filed May 30, 1997.

BACKGROUND OF THE INVENTION

1. Field of the Invention

The present invention relates to a shelf-mounted tubular swing away sign, particularly one which may be mounted on supermarket type panels conventionally designed to display product and pricing information.

2. The Prior Art

It is known in the prior art to attach visual displays to display counters using rigid clips. These rigid clips, however, are prone to breakage when an object hits into the visual display. The failure of the clips has several drawbacks. First, the display is no longer visible and is of little advertising value. Second, the resulting damage done to the clips and sign will require repair and unnecessary expense. Finally, a sign which has fallen to the floor creates a hazardous condition whereby customers may trip and injure themselves.

In addition, displays have been created which extend in a planar fashion perpendicularly from the display counter. This arrangement protrudes into the customers walking area and could pose a hazardous condition.

SUMMARY OF THE INVENTION

It is an object of the present invention to provide a tubular swing away sign which is attached to a display counter via a flexible clip. It is a further object of the invention to provide an inexpensive device for displaying advertisements or notices which can withstand mild lateral forces associated with passing consumers.

It is a final object of the invention to provide a clear tubular sign which maximizes display area and minimizes the protrusion of the sign into the customers walkway.

BRIEF DESCRIPTION OF THE DRAWINGS

Other objects and features of the present invention will become apparent from the following detailed descriptions considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1A:
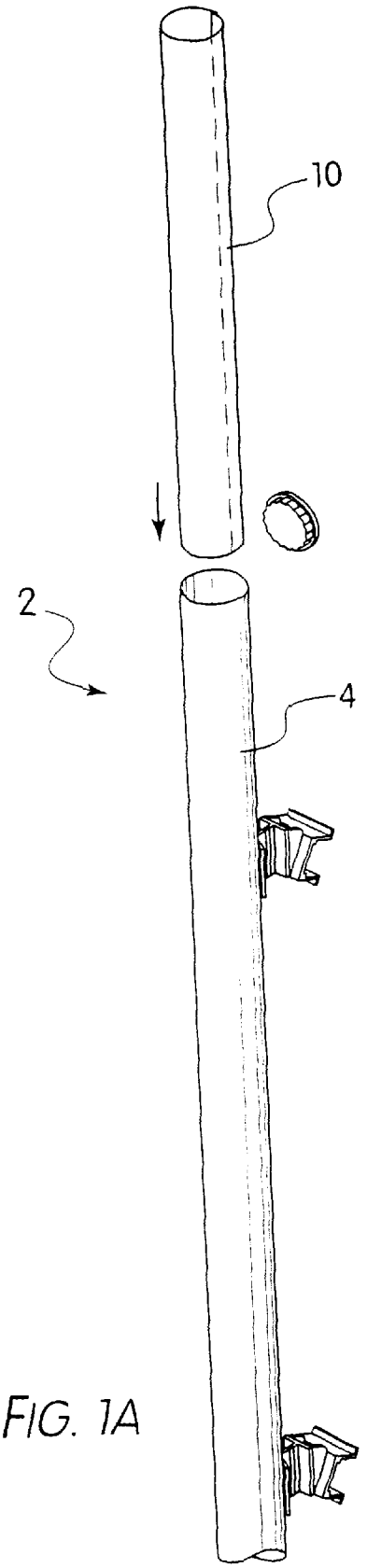
FIG. 1*a* shows a vertical representation of the loading of a graphic into the tubular swing away sign.

Turning now in detail to the drawings, FIG. 1*a* shows the invention 2 which comprises a sign tube 4, which is a transparent hollow cylinder. A graphic sheet or sign insert 10 is rolled to fit within cylinder 4 and provide the graphic display.

Figure 1B:
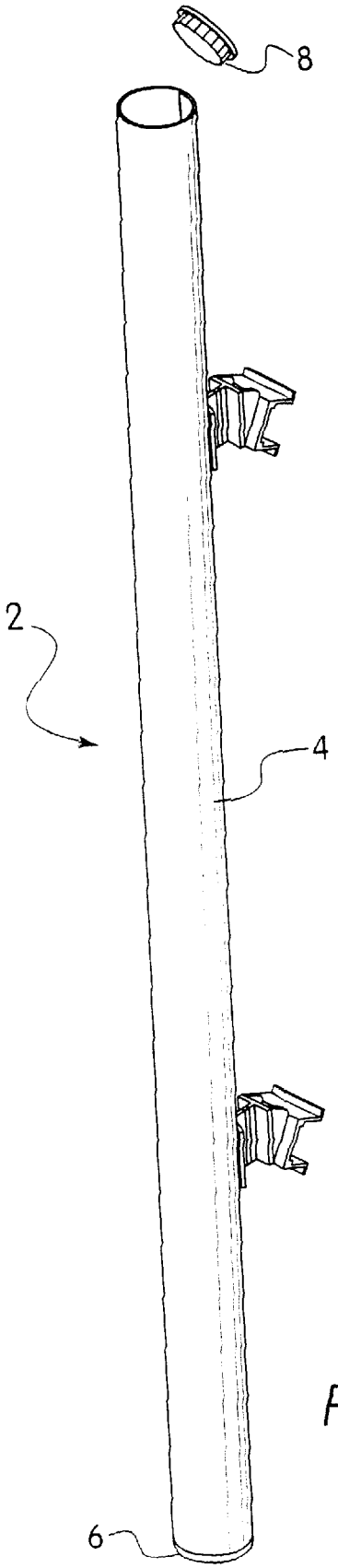
FIG. 1*b* shows a vertical representation of the tubular swing away sign.

Referring to FIG. 1*b,* a vacuum formed bottom cap 6 is fixed in place at the bottom end of the sign tube 4 and a vacuum formed snap-on top cap 8 is removably connected to the top end of the sign tube 4.

Figure 2A:
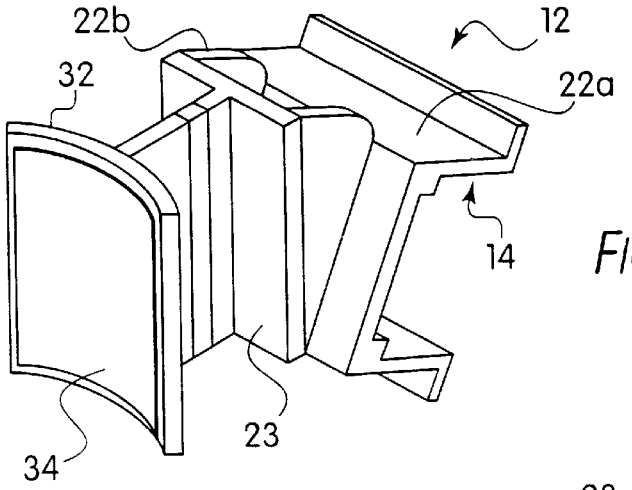
FIG. 2*a* shows an enlarged diagram of the flexible clip used to secure the tubular swing away sign to the display counters.
Figure 2B:
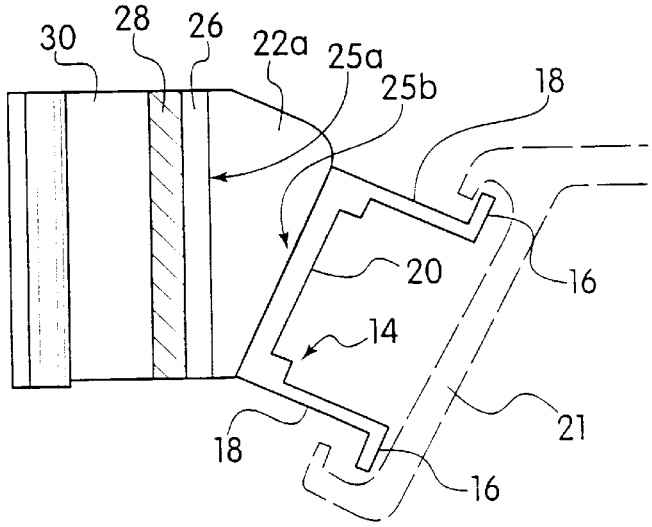
FIG. 2*b* shows a side view of the flexible clip used to secure the tubular swing away sign to the display counters.

Referring to FIG. 2*a* and FIG. 2*b,* there is shown sign tube mount 12, which comprises an injection molded shelf channel clip 14, which includes two tabs 16, two legs 18 and a joining plate 20. One or more of these clips are snapped into place on the existing store shelf channel 21, which channel is of a conventional standardized design for placing shelf headers and footers. The channel is conventionally angled about 25° from vertical. From joining plate 20, a pair of wedge shaped spacer fins 22A and 22B mount to vertical plate 23. The wedge shaped spacer fins 22A and 22B each contain a vertical side 25A and a mounting side 22B which form a 25° angle between them. A third fin 24 extends from vertical plate 23 and comprises three parts: a short segment 26, a hinge 28, and a longer segment 30. The longer segment 30 extends a short distance beyond hinge 28 to provide increased leverage, thereby reducing the amount of force applied by hinge 28, and making it easier to move tube 4, thereby reducing the possibility of injury to tube 4 or to any person who comes into contact with the tube 4.

At the end of longer segment 30, mount 32 comprises a section of a cylinder having approximately 70° of an arc. Mount 32 has an inner radius of curvature similar to an outer radius of cylinder 4. Foam double stick tape 34 is affixed to the inside of the semi-cylindrical mount 32. A protective backing is peeled off the foam tape, and cylinder 4 is placed at the right height on one or more sign tube mounts 12, and pressed into place where the tape adheres it to mount 32. The shelf-mounted tubular swing-away sign is then in place and on display. Many other methods can be used to adhere the sign tube 4 to the mount 32.

Figure 3:
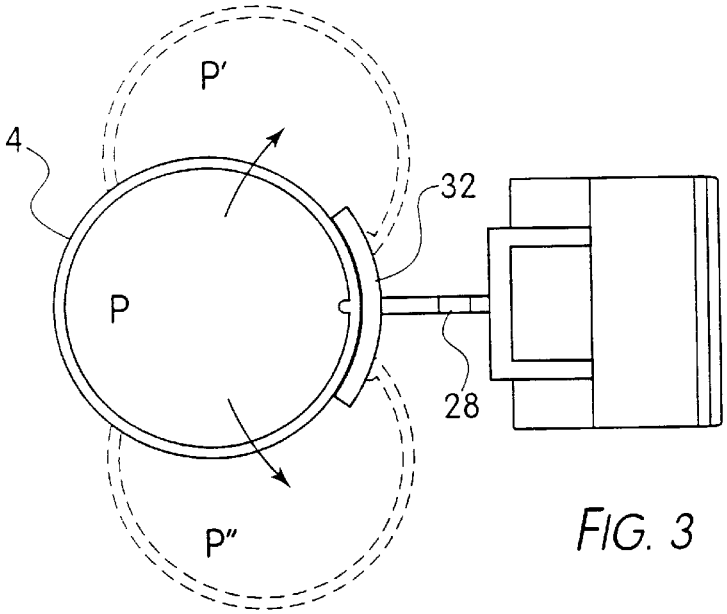
FIG. 3 shows a plan view of the tubular sign and flexible clip.

Referring to FIG. 3, there is shown a plan view detailing the at rest position P of the tube 4. In addition, there is shown two displaced positions, P' and P", which correspond to the position of tube 4 when deflected from either the right or left directions respectively, facing the tube 4.

Accordingly, while a single embodiment of the present invention has been shown and described, it is to be understood that many changes and modifications may be made thereunto without departing from the spirit and scope of the invention as defined in the appended claims.

What is claimed is:

1. A tubular swing away sign comprising:

a cylindrical tube having a top end and a bottom end, wherein said tube is made out of a transparent material;

a vacuum formed bottom cap, fixedly connected to said bottom end;

a vacuum formed top cap, removably connected to said top end;

an injection molded shelf channel clip, adapted to be removably connected in an obliquely angled shelf channel of a display shelf;

a wedge shaped spacer having a first side and a mounting side forming an angle of 25° with respect to the first side, wherein said mounting side is fixedly attached to said channel clip;

a semi-circular mounting clip having a concave side and a convex side;

an extender segment having a first extender side and a second extender side, wherein said first extender side is fixedly attached to said convex side of said mounting clip and said second side is laterally pivotally connected to said first side of said wedge shaped spacer, wherein said wedge shaped spacer positions the longitudinal axis of the tube at an angle of 25° with respect to the mounting side of the spacer, wherein the longitudinal axis of the tube is vertical when the channel chip is mounted in the obliquely angled shelf channel; and a double sided adhesive strip fixedly attached to said concave side of said mounting clip and fixedly attached to said cylindrical tube.

* * * * *